US005616075A

United States Patent [19]

Winstanley et al.

[11] Patent Number: 5,616,075

[45] Date of Patent: Apr. 1, 1997

[54] COIN DISPENSING APPARATUS

[75] Inventors: Nigel A. Winstanley; John A. Weston; Colin A. G. Musto, all of Berkshire, United Kingdom

[73] Assignee: Mars Inc., McLean, Va.

[21] Appl. No.: 481,454

[22] PCT Filed: Jan. 11, 1994

[86] PCT No.: PCT/GB94/00049

§ 371 Date: Dec. 22, 1995

§ 102(e) Date: Dec. 22, 1995

[87] PCT Pub. No.: WO94/16411

PCT Pub. Date: Jul. 21, 1994

[30] Foreign Application Priority Data

Jan. 12, 1993 [GB] United Kingdom ..... 9300505

[51] Int. Cl.[6] ..... G07D 1/00

[52] U.S. Cl. ..... 453/41; 194/200

[58] Field of Search ..... 453/20, 21, 40, 453/41; 194/200

[56] References Cited

U.S. PATENT DOCUMENTS 3,943,950 3/1976 Thur et al. ..... 453/55

4,398,550 8/1983 Shireman ..... 453/41 X

FOREIGN PATENT DOCUMENTS 3315982 11/1984 Germany .

3810074 5/1989 Germany .

4-315287 11/1992 Japan ..... 453/21

*Primary Examiner*—F. J. Bartuska

*Attorney, Agent, or Firm*—Fish & Richardson P.C.

[57] ABSTRACT

A coin dispensing apparatus has a single motor for causing coins to be dispensed selectively from either one or two stores. Rotation of the motor shaft in the first direction is transmitted via a one-way clutch to cause movement of a dispensing arm associated with the first store, and rotation of the shaft in the opposite direction is transmitted via a second one-way shaft to cause movement of the dispensing arm associated with the second store. If a jam is detected, the direction of rotation of the motor shaft is repeatedly reversed to clear the jam, the amount of reverse movement of the shaft being less than the lost motion in the associated one-way clutches so that the other motor dispensing arm is not substantially moved.

22 Claims, 6 Drawing Sheets

FIG.2
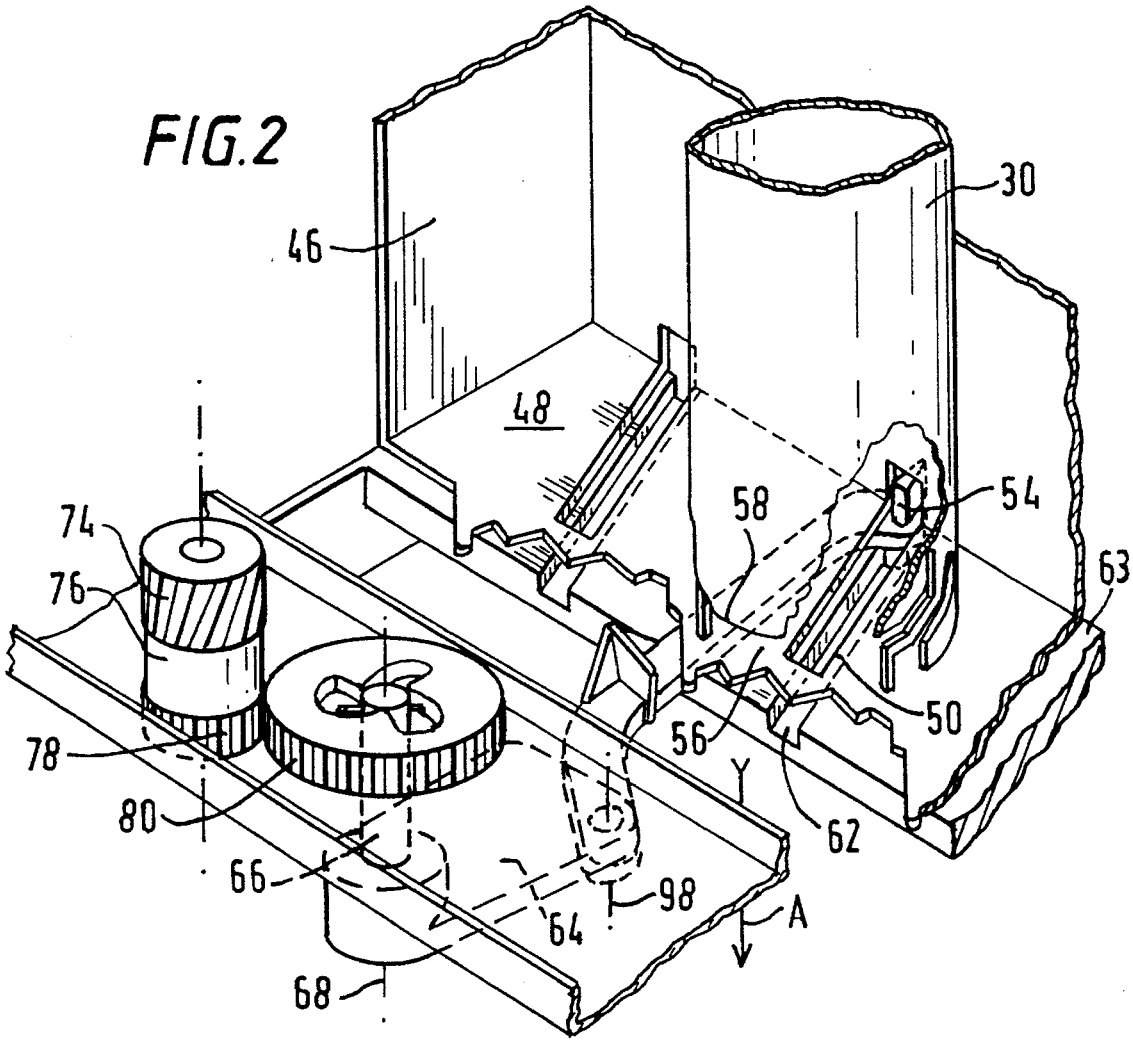
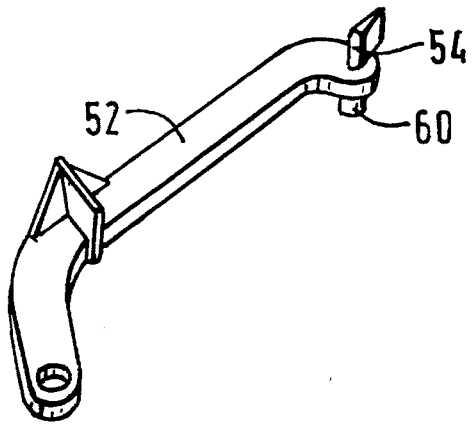
FIG.3

70
72
74
76
78
80
82
88
66
98
96
64
96
52

COIN DISPENSING APPARATUS

FIELD OF THE INVENTION

This invention relates to coin dispensing apparatus.

BACKGROUND OF THE INVENTION

Various types of devices are known for dispensing coins, for example in change giving apparatus. Coins are commonly stored in tubes within each of which coins of a respective denomination are stacked face-to-face. The coins are usually dispensed by sliding the bottommost coin laterally out of the stack. One proposed arrangement incorporates a motor having a shaft which, when rotated in a first direction, drives a one-way clutch to operate a dispensing arm which strips the bottommost coin from a first stack, and which when rotated in the opposite direction drives a further dispensing arm via a second one-way clutch so that the bottommost coin of a second stack is dispensed.

Most, if not all, coin dispensers of all types suffer at least to some extent from occasional jamming problems when a coin is bent or deformed or becomes lodged in the wrong position and prevents correct dispensing. It would be desirable to provide an arrangement in which such problems are at least mitigated.

SUMMARY OF THE INVENTION

According to the present invention there is provided coin dispensing apparatus comprising:

at least first and second coin stores each for storing a plurality of coins;

first and second dispensing members associated respectively with said first and second coin stores, each dispensing member being operable to execute a dispensing movement to dispense a coin from the respective store;

a dispensing actuator for driving the dispensing members, the actuator comprising a motor which can drive a shaft in either of first and second opposite directions and transmission means coupling the shaft to the dispensing members in such a way that rotation of the shaft in the first direction causes the first dispensing member to execute a dispensing movement and rotation of the shaft in the second direction causes the second dispensing member to execute a dispensing movement; and control means for controlling the operation of the dispensing actuator;

wherein the control means is operable, when a coin is to be dispensed from the first store, to cause the motor to drive the shaft in the first direction, then briefly in the second direction and then again in the first direction, so as to tend to clear a jam which may be preventing correct dispensing from said first store, the rotation of the shaft in the second direction being insufficient to cause substantial movement of the second dispensing member.

The brief reversal of rotation of the shaft, followed by the re-commencement of the forward rotation (which is preferably carried out a plurality of times) causes the first dispensing member to be moved in a type of "hammer action" which would tend to clear any jam preventing dispensing. The control means can be arranged to apply similar movement to the dispensing member of the second store.

The transmission between the shaft and the second dispensing member preferably includes a lost-motion coupling, and the reversed motion of the shaft is preferably such that it does not exceed the lost motion provided by this coupling so that no movement of the second dispensing member occurs during this reversed rotation. This lost-motion coupling is preferably a one-way clutch which causes the second dispensing member to be driven only when the shaft is rotated in the second direction. There may be an additional degree of lost motion at other places in the transmission, the arrangement being such that the movement caused by the reversed rotation of the shaft is less than the sum of the total lost motion in the transmission.

Also, or alternatively, the transmission means may be arranged such that the degree of movement of the second dispensing member for a given amount of rotation of the shaft varies during the dispensing cycle, the reverse rotation of the shaft occurring when the dispensing member is positioned such that it moves only by a very small amount in response to shaft rotation.

These arrangements ensure that the hammer action applied to the first dispensing member does not have any adverse effects on the dispensing mechanism for the second coin store.

Preferably, the motor is a DC motor. Preferably, the above-mentioned shaft is the motor shaft, and preferably this shaft is rotated in opposite directions by reversing the polarity of the voltage supplied to the motor.

BRIEF DESCRIPTION OF THE DRAWINGS

An arrangement embodying the invention will now be described by way of example with reference to the accompanying drawings, in which:

FIG. 2 is a schematic perspective view for explaining how coins are dispensed from the coin stores of the dispensing apparatus;

FIG. 3 shows a dispensing member;

DETAILED DESCRIPTION OF THE INVENTION

Figure 1:
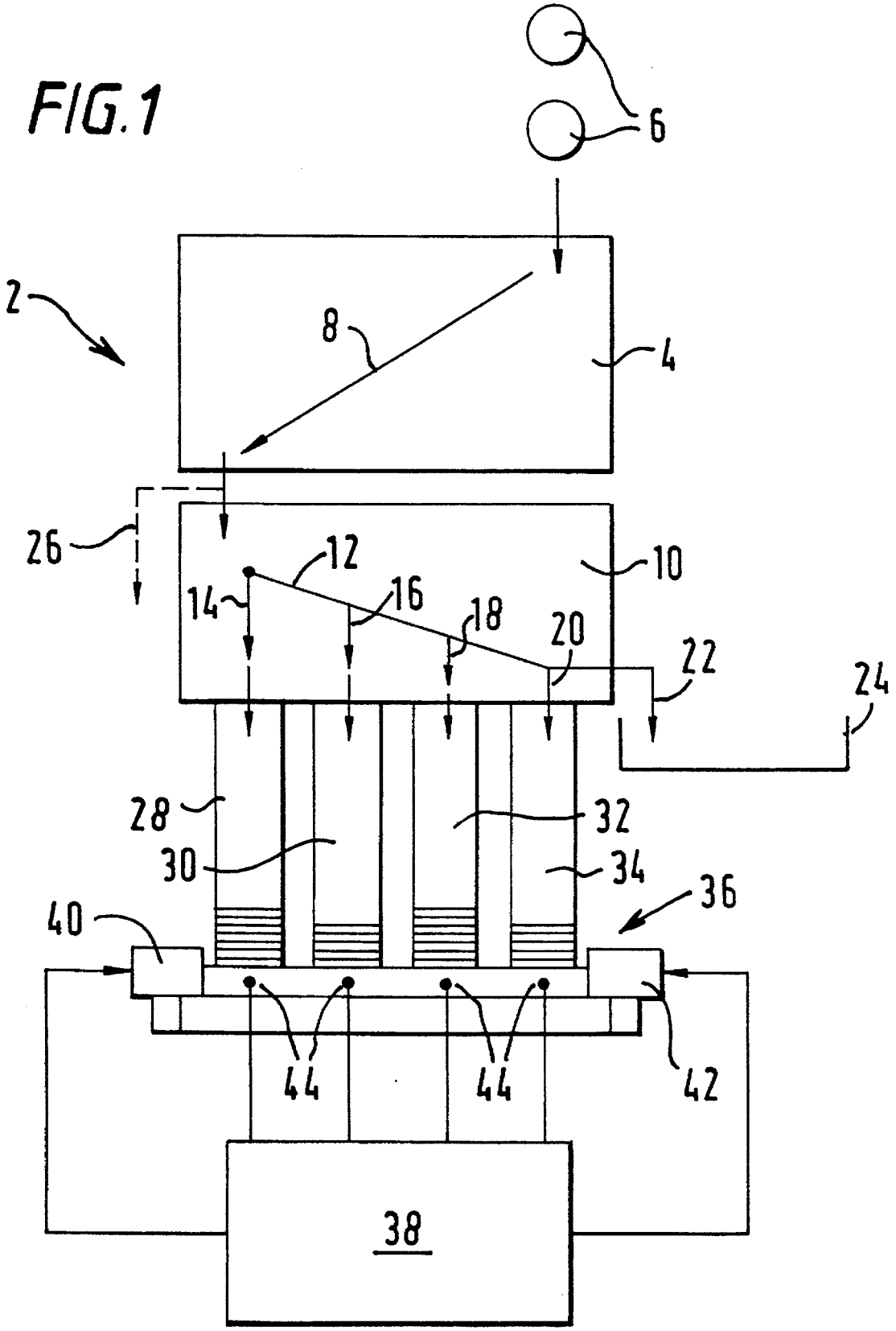
FIG. 1 is a schematic view of a coin handling apparatus including a coin dispensing apparatus according to the present invention.
Figure 4:
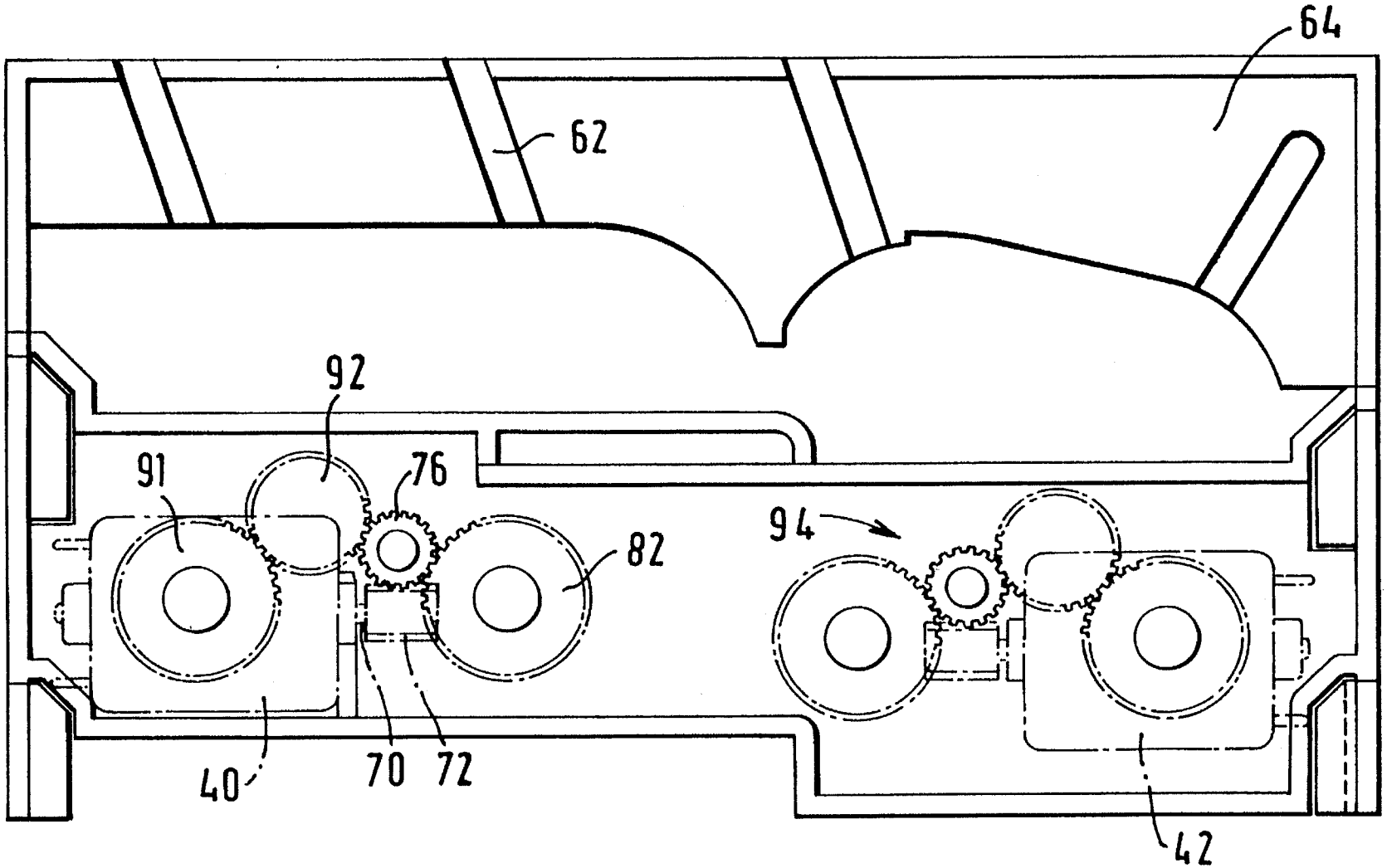
FIG. 4 is a plan view showing the motors and transmissions of the dispensing apparatus.
Figure 5:
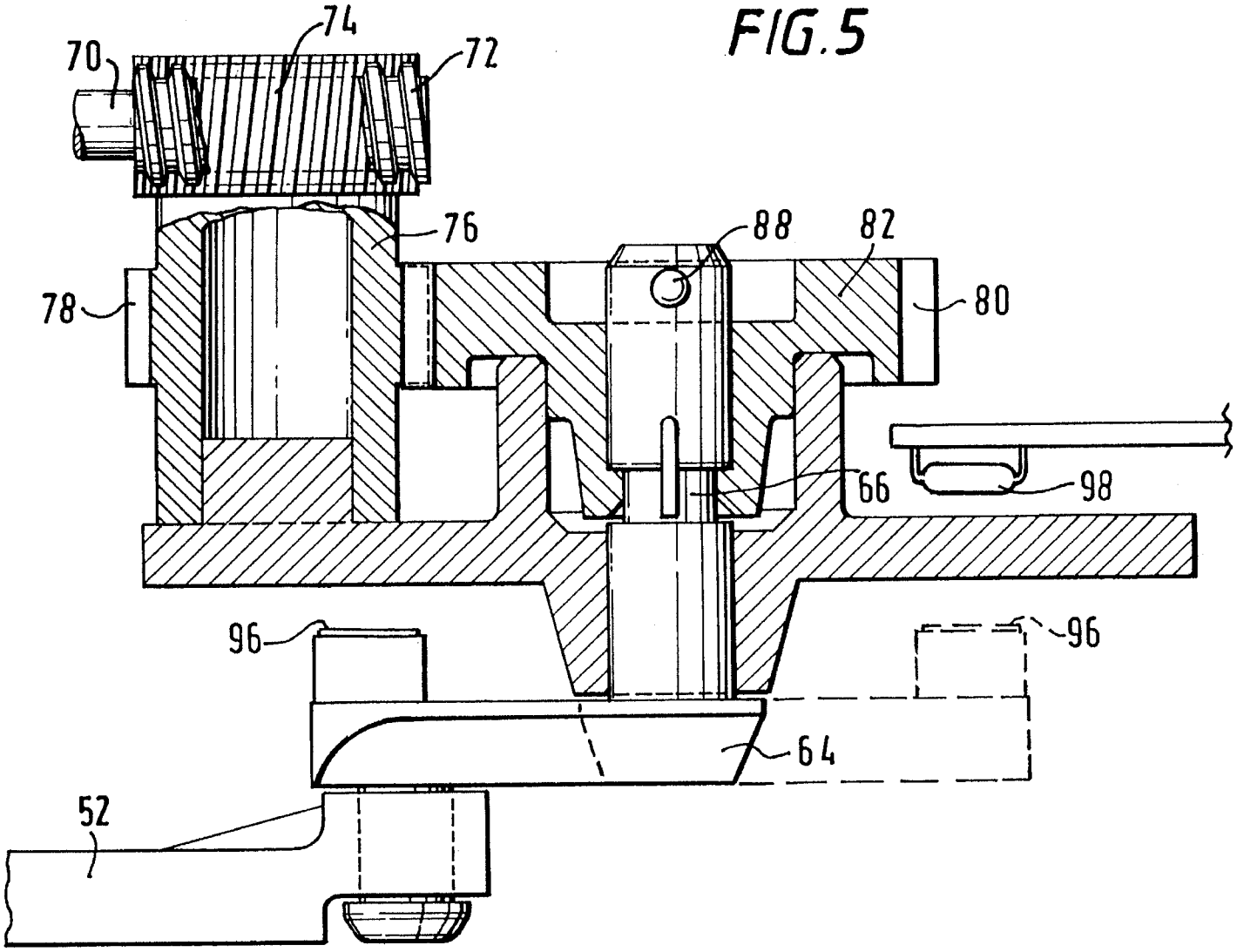
FIG. 5 is a cross-sectional view of part of the transmission associated with the dispensing arrangement of one of the stores of the dispensing apparatus.

Referring to FIG. 1, the coin handling apparatus 2 includes a coin validator 4 for receiving coins as indicated at 6. During the passage of the coins 6 along a path 8 in the validator 4, the validator provides signals indicating whether the coins are acceptable, and if so the denomination of the coins.

Acceptable coins then enter a coin separator 10, which has a number of gates (not shown) controlled by the circuitry of the apparatus for selectively diverting the coins from a main path 12 into any of a number of further paths 14, 16, 18 and 20, or allowing the coins to proceed along the path 12 to a path 22 leading to a cashbox 24. If the coins are unacceptable, instead of entering the separator 10 they are led straight to a reject slot via a path 26.

Each of the paths 14, 16, 18 and 20 leads to a respective one of four coin tubes or containers 28, 30, 32, and 34. Each of these containers is arranged to store a vertical stack of coins of a particular denomination. Although only four containers are shown, any number may be provided.

A dispenser indicated schematically at 36 is operable to dispense coins from the containers when change is to be given by the apparatus. The dispenser 36 comprises a control means 38 which is arranged to drive two motors, 40 and 42. As will be explained below, rotation of the shaft of the motor 40 in one direction causes a coin to be dispensed from container 28, and in the other direction causes a coin to be dispensed from the container 30. Similarly, rotation of the shaft of the motor 42 in one direction causes a coin to be dispensed from the container 32, and in the other direction causes a coin to be dispensed from the container 34. The control means 38 can thus individually dispense coins from any selected container. The control means responds to signals from four sensors 44, each associated with the respective one of the containers.

Referring to FIG. 2, this illustrates how a coin is dispensed, and for purposes of clarity shows the lower end of only one of the containers, 30. The containers are mounted in a housing 46. The containers are open at the bottom so that the stack of coins rests on the bottom surface 48 of the housing 46. This bottom surface 48 is formed with a slot 50 underneath each container.

A dispensing arm or member 52, shown more clearly in FIG. 3, extends underneath the bottom surface 48 of the housing 46, and has a coin-pushing extension 54 which projects upwardly from one end of the member 52 and which projects through the slot 50. As will be described below, the arm 52 can be moved substantially in the direction of its length, which will cause the projection 54 to move along the slot 50 from the rear of the container 30, engaging the edge of the lowermost coin in the container, so that this coin is pushed out of the container through a space 56 between the lower front edge 58 of the container 30 and the housing bottom surface 48. The coin will thus be allowed to fall from the dispensing apparatus in the direction of arrow A. The dispensing arm 52 has a guiding extension 60 projecting downwardly from the end of the member 52 and locating in a recess 62 provided in a base member 63 located beneath the housing 46 so as more accurately to guide the movement of the member 52.

The end of the dispensing arm 52 opposite the extension 54 is pivotably mounted to a crank arm 64, which is mounted on a shaft 66 for rotation about an axis 68. A single rotation of the shaft 66 will move the crank arm 64 from the position shown in FIG. 2, wherein the dispensing arm 52 is in its home position, in such a way that the dispensing arm is pulled forwardly along the length of the slot 50, and then pushed backwardly along the slot to the home position. This constitutes a single dispensing cycle.

Referring now additionally to FIGS. 4 to 7, the motor 40 has a shaft 70 on which is mounted a worm 72. This drivingly engages the splines 74 of a shaft 76 mounted for rotation about a substantially vertical axis. The shaft 76 has gear teeth 78 around its lower periphery which mesh with the teeth 80 of a clutch wheel 82. The clutch wheel 82 is mounted on the shaft 66.

Figure 6:
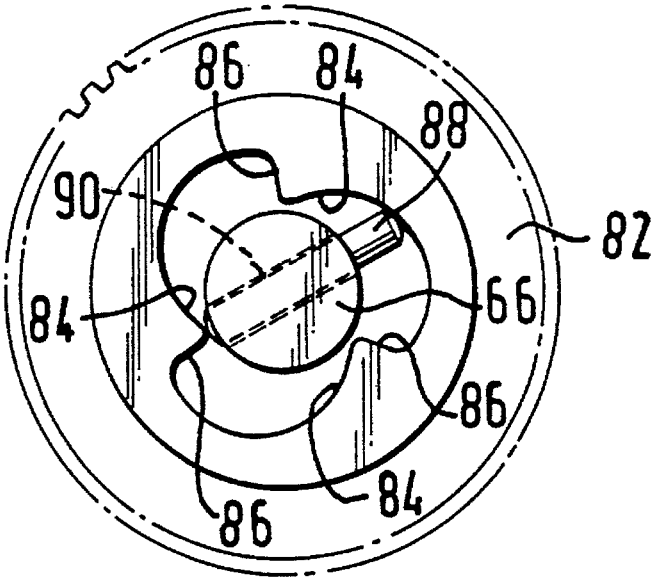
FIGS. 6 and 7 illustrate a one-way clutch of this dispensing arrangement.
Figure 7:
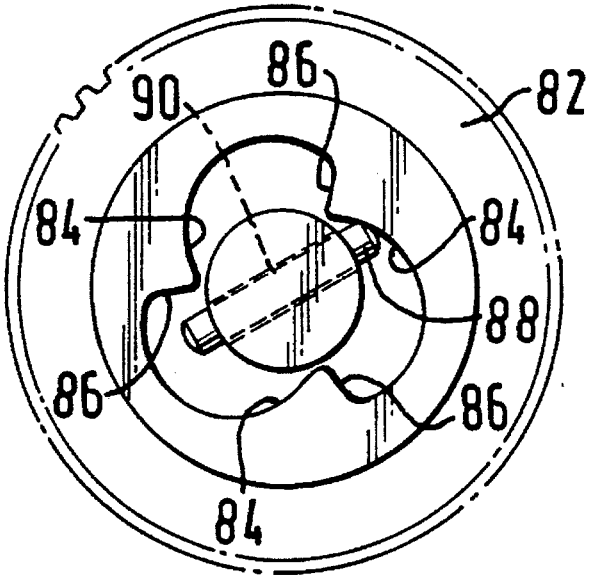

The inner periphery of the clutch wheel 82 is formed of cam surfaces 84 and drive surfaces 86 which engage the ends of a pin 88 which is freely slidable within a substantially horizontally extending bore 90 through the shaft 66. FIG. 6 shows the pin 88 extending outwardly of the shaft 66 by the maximum amount, and FIG. 7 shows the pin 88 with its ends projecting by the minimum amount. Assuming that the gear wheel 82 rotates clockwise as shown in FIGS. 6 and 7, the ends of the pin 88 will repeatedly engage the cam surfaces 84 which will cause the pin 88 to be repeatedly pushed backwards and forwards through the bore 90. Therefore, no rotation of the shaft 66 will occur. However, anti-clockwise rotation of the clutch wheel 82 will cause one end of the pin to be engaged by a drive surface 86. The drive surface 86 extends substantially radially with respect to the axis of rotation, so there will be no reaction forces between the pin and the drive surface 86 which would tend to move the pin longitudinally. Accordingly, continued rotation of the clutch wheel 88 will transmit a driving force to the pin 88 and thus rotate the shaft 66.

It will be noted that the inner periphery of the clutch wheel 82 as shown in FIGS. 6 and 7 consists of three lobes, each forming a cam surface 84 and a drive surface 86, so that taking into account that both ends of the pin 88 are engageable with the inner periphery, it will be understood that the maximum amount of anti-clockwise rotation of the clutch wheel 82 which may occur before a drive surface 86 drivingly engages the pin 88 is 60°.

In order to dispense a coin from the container 30 shown in FIG. 2, the DC motor 40 is supplied with a drive voltage of a first polarity, which causes its output shaft 70 to rotate in a first direction, resulting in the clutch wheel 82 moving anti-clockwise. This will cause the shaft 66 and thus the crank 64 to rotate and thus reciprocate the extension 54 along the slot 50 and dispense a coin.

The shaft 76 is also coupled to a further clutch wheel 90 via an idling gear 92. This clutch wheel 90 is coupled to a different dispensing arm (not shown) for dispensing coins from the container 28. The arrangement is similar to that described above. Because of the presence of the idling gear 92, the clutch wheels 90 and 82 will rotate in opposite directions. Accordingly, when the motor 40 is driven such that its output shaft 70 rotates in the second, opposite direction, the clutch wheel 90 rotates anti-clockwise and causes its associated dispensing member to dispense a coin from the container 28. However, this will result in a clockwise rotation of the clutch wheel 82, so that the shaft 66 is not rotated and the dispensing arm 52 is not substantially moved. Coins can thus be selectively dispensed from either of the containers 28 or 30 by selecting the direction of rotation of the motor shaft 70 (and the shaft 76).

The motor 42 is coupled to a similar transmission system shown generally at 94 for selectively dispensing coins from the containers 32 and 34.

Each crank arm 64 has embedded therein or attached thereto a magnet 96 (FIG. 5) which is arranged to operate a respective reed switch 98 constituting one of the sensors 44 mentioned above. This occurs when the crank arm 64 is in the home position shown in FIG. 2.

Figure 8:
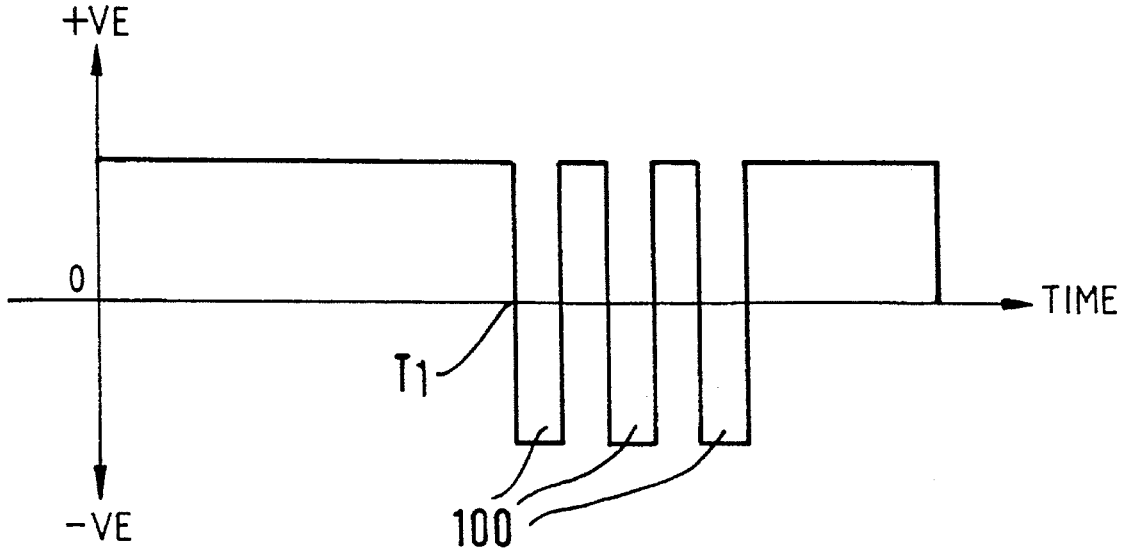
FIG. 8 is a voltage waveform diagram illustrating the voltage supply to a motor of the dispensing apparatus when a jam has been detected.

The operation of the control means 38 is as follows. Assuming that a coin is to be dispensed from the container 28, a supply voltage, of e.g. positive polarity, is applied to the motor 40 so that the clutch wheel 90 is rotated anti-clockwise. This supply voltage is maintained until the associated sensor 44 indicates that the crank arm has returned to its home position, thus signifying that a coin has been dispensed. Referring to FIG. 8, if no such home signal is provided within a predetermined period T1, of e.g. half a second, the polarity of the supply voltage is reversed for a period of, for example, 60 milliseconds. A positive supply voltage is then applied for a similar period, followed by further brief applications of negative, positive and then negative supply voltages for similar periods. There will thus be three intervals, indicated at 100 in FIG. 8, during which the clutch wheel 90 is rotated clockwise and therefore the dispensing member associated with the container 28 ceases to be driven, following each of which periods the drive is reapplied. This application of the drive force in a pulse manner creates a hammer action producing vibration which tends to free a coin jam which may prevent the dispensing member from completing its action. The positive supply voltage is then reapplied for a further period of, for example, half a second, or until the home position signal is obtained from the sensor 44 as a result of the jam being cleared and the dispensing member completing its action. (If no such home position signal is obtained, the control means 38 can be arranged if desired to store an indication that there is a problem with dispensing from the container 28.)

During each of the intervals 100, the clutch wheel 82 will be driven anti-clockwise, and thus in the direction which would tend to operate the associated dispensing member 52. However, the duration of each interval 100 is equal to or less than the time taken for the clutch wheel 82 to rotate by 60°, which is the degree of lost motion in the clutch wheel as mentioned above. It is possible that in the first interval 100 the pin 88 may be located close to one of the drive surfaces 86 and therefore some slight movement of the shaft 66 and thus the dispensing arm 52 may occur, but because subsequent reverse-drive intervals are limited to the lost motion in the clutch, there will be no appreciable additional movement during those subsequent intervals.

It would be possible to have the forward-drive intervals between the intervals 100 slightly longer than the intervals 100 so as to ensure that drive force was positively applied to cause the hammer action. This would also result in a progressive movement of the dispensing member 52 if such is permitted by the jam. In practice, however, it is found that an acceptable hammer action occurs if the forward-drive interval is kept substantially equal to the reverse-drive interval 100. It has been found that the vibration caused by this action is adequate to free many jams, and that it would be rare for progressive forward movement during the hammer action to have any beneficial effects.

As mentioned above, there may be some slight movement of the crank arm 64 associated with the container 30 from which coins are not to be dispensed. The crank arm 64 at this time will be in its home position and, with reference to FIG. 2, it will be noted that the pivot axis 98 by which the dispensing arm 58 is mounted to the crank arm 64 is located in proximity to a line joining the axis of the shaft 66 to the extension 64. This means that angular movement of the crank arm 64 from its home position will cause relatively little movement of the extension 64, as compared with the situation when the crank arm 64 has been rotated by, for example 90°, when slight additional movement will cause substantial movement of the extension 54. Any slight movement which does occur therefore at the home position will be of a negligible amount.

Although the invention has been described in the context of coin stores in the form of tubes in which coins are stacked face-to-face, other forms of coin store may be used.

The sensors 44 in the above embodiment operate by detecting that the dispensing member 52 has not moved sufficiently, thus indicating that there is a jam. This detection operation can be performed by sensing the movement of the member 52 itself or an associated element (such as the crank arm 64 as in the above embodiment). A jam could alternatively be detected by a sensor which detects whether a coin has been dispensed following operation of a motor. As a further alternative, the hammer action can be performed on every dispensing cycle, thus avoiding the need for a jam sensor.

We claim:

1. Coin dispensing apparatus comprising:

at least first and second coin stores each for storing a plurality of coins;

first and second dispensing members associated respectively with said first and second coin stores, each dispensing member being operable to execute a dispensing movement to dispense a coin from the respective store;

a dispensing actuator for driving the dispensing members, the actuator comprising a motor which can drive a shaft in either of first and second opposite directions and transmission means coupling the shaft to the dispensing members in such a way that rotation of the shaft in the first direction causes the first dispensing member to execute a dispensing movement and rotation of the shaft in the second direction causes the second dispensing member to execute a dispensing movement; and control means for controlling the operation of the dispensing actuator;

wherein the control means is operable, when a coin is to be dispensed from the first store, to cause the motor to drive the shaft in the first direction, then briefly in the second direction and then again in the first direction, so as to tend to clear a jam which may be preventing correct dispensing from said first store, the rotation of the shaft in the second direction being insufficient to cause substantial movement of the second dispensing member.

2. An apparatus as claimed in claim 1, wherein the transmission means includes a lost-motion coupling between the shaft and the second dispensing member so that the first part of the coupling can be moved in response to rotation of the shaft in the second direction by a predetermined amount before a second part of the coupling connected to the dispensing member is moved, said brief rotation of the shaft in the second direction being such that the first part of the coupling is moved by an amount which does not exceed said predetermined amount.

3. Apparatus as claimed in claim 2, wherein the lost-motion coupling is a clutch in which rotation of the shaft in the second direction causes the first part of the coupling to drive the second part, and which is arranged such that when the shaft is rotated in the first direction the second part is no longer driven by the first part.

4. Apparatus as claimed in claim 3, wherein the first part of the clutch comprises a wheel driven by the shaft, and the second part comprises a further shaft having a radially-moveable driving member extending radially outwardly therefrom, the drive member being engageable with the inner periphery of the wheel, said inner periphery comprising at least one cam surface arranged such that as the wheel is rotating in the first direction the cam surface causes radial movement of the drive member, and at least one drive surface arranged such that rotation of the shaft in the second direction causes the drive surface to drivingly engage the drive member and thus rotate the further shaft.

5. Apparatus as claimed in claim 1, wherein the control means is operable to cause the motor to drive the shaft in the second direction a plurality of times, the shaft being driven in the first direction between such times, when a coin is to be dispensed from the first store.

6. Apparatus as claimed in claim 5, wherein the periods for which the shaft is driven in the second direction are substantially equal to the intervening periods for which the shaft is driven in the first direction.

7. Apparatus as claimed in claim 1, wherein the brief rotating of the shaft in the second direction during dispensing from the first store is performed in response to detection of a jam.

8. Apparatus as claimed in claim 7, further including means for detecting a jam by sensing that the transmission means has failed to move the dispensing member by a predetermined amount.

9. Apparatus as claimed in claim 7, further including means for detecting a jam by sensing that no coin has been dispensed from the store.

10. Apparatus as claimed in claim 1, wherein the control means is operable, when a coin is to be dispensed from the second store, to drive the shaft in the second direction, then briefly in the first direction and then again in the second direction, so as to tend to clear a jam which may be preventing correct dispensing from said second store.

11. Apparatus as claimed in claim 1, wherein the motor is arranged to rotate the shaft in the first direction when supplied with a drive voltage of a first polarity, and in the second direction when supplied with a drive voltage of a second, opposite polarity.

12. Coin handling apparatus comprising:

coin dispensing apparatus comprising:

(a) at least first and second coin stores each for storing a plurality of coins;

(b) first and second dispensing members associated respectively with said first and second coin stores, each dispensing member being operable to execute a dispensing movement to dispense a coin from the respective store;

(c) a dispensing actuator for driving the dispensing members, the actuator comprising a motor which can drive a shaft in either of first and second opposite directions and transmission means coupling the shaft to the dispensing members in such a way that rotation of the shaft in the first direction causes the first dispensing member to execute a dispensing movement and rotation of the shaft in the second direction causes the second dispensing member to execute a dispensing movement; and (d) control means for controlling the operation of the dispensing actuator; and a coin validator for receiving and testing coins and for selectively delivering coins which are deemed to be valid to the stores of coin dispensing apparatus, wherein the control means is operable, when a coin is to be dispensed from the first store, to cause the motor to drive the shaft in the first direction, then briefly in the second direction and then again in the first direction, so as to tend to clear a jam which may be preventing correct dispensing from said first store, the rotation of the shaft in the second direction being insufficient to cause substantial movement of the second dispensing member.

13. An apparatus as claimed in claim 12, wherein the transmission means includes a lost-motion coupling between the shaft and the second dispensing member so that the first part of the coupling can be moved in response to rotation of the shaft in the second direction by a predetermined amount before a second part of the coupling connected to the dispensing member is moved, said brief rotation of the shaft in the second direction being such that the first part of the coupling is moved by an amount which does not exceed said predetermined amount.

14. Apparatus as claimed in claim 13, wherein the lost-motion coupling is a clutch in which rotation of the shaft in the second direction causes the first part of the coupling to drive the second part, and which is arranged such that when the shaft is rotated in the first direction the second part is no longer driven by the first part.

15. Apparatus as claimed in claim 14, wherein the first part of the clutch comprises a wheel driven by the shaft, and the second part comprises a further shaft having a radially-moveable driving member extending radially outwardly therefrom, the drive member being engageable with the inner periphery of the wheel, said inner periphery comprising at least one cam surface arranged such that as the wheel is rotating in the first direction the cam surface causes radial movement of the drive member, and at least one drive surface arranged such that rotation of the shaft in the second direction causes the drive surface to drivingly engage the drive member and thus rotate the further shaft.

16. Apparatus as claimed in claim 12, wherein the control means is operable to cause the motor to drive the shaft in the second direction a plurality of times, the shaft being driven in the first direction between such times, when a coin is to be dispensed from the first store.

17. Apparatus as claimed in claim 16, wherein the periods for which the shaft is driven in the second direction are substantially equal to the intervening periods for which the shaft is driven in the first direction.

18. Apparatus as claimed in claim 12, wherein the brief rotating of the shaft in the second direction during dispensing from the first store is performed in response to detection of a jam.

19. Apparatus as claimed in claim 18, further including means for detecting a jam by sensing that the transmission means has failed to move the dispensing member by a predetermined amount.

20. Apparatus as claimed in claim 18, further including means for detecting a jam by sensing that no coin has been dispensed from the store.

21. Apparatus as claimed in claim 12, wherein the control means is operable, when a coin is to be dispensed from the second store, to drive the shaft in the second direction, then briefly in the first direction and then again in the second direction, so as to tend to clear a jam which may be preventing correct dispensing from said second store.

22. Apparatus as claimed in claim 12, wherein the motor is arranged to rotate the shaft in the first direction when supplied with a drive voltage of a first polarity, and in the second direction when supplied with a drive voltage of a second, opposite polarity.

* * * * *

UNITED STATES PATENT AND TRADEMARK OFFICE

CERTIFICATE OF CORRECTION

PATENT NO. : 5,616,075

DATED : April 1, 1997

INVENTOR(S) : Nigel A. Winstanley et al.

It is certified that error appears in the above-identified patent and that said Letters Patent is hereby corrected as shown below:

Col. 4, line 33, cancel "90" and insert --91--.

Col. 4, line 34, cancel "90" and insert --91--.

Col. 4, line 38, cancel "90" and insert --91--.

Col. 4, line 41, cancel "90" and insert --91--.

Col. 4, line 60, cancel "90" and insert --91--.

Col. 5, line 6, cancel "90" and insert --91--.

Signed and Sealed this

Twenty-sixth Day of May, 1998

*Attest:*

Bruce Lehman

BRUCE LEHMAN

*Attesting Officer*

*Commissioner of Patents and Trademarks*